United States Patent [19]

Lewis

[11] 4,236,965

[45] Dec. 2, 1980

[54] TARGET ASSEMBLY

[75] Inventor: Richard A. Lewis, Falls Church, Va.

[73] Assignee: The United States of America as represented by the United States Department of Energy, Washington, D.C.

[21] Appl. No.: 958,863

[22] Filed: Nov. 8, 1978

[51] Int. Cl.[3] ..... G21G 1/10

[52] U.S. Cl. ..... 176/11; 176/18; 176/77; 176/78

[58] Field of Search ..... 176/78, 77, 50, 61, 176/18, 11

[56] References Cited

U.S. PATENT DOCUMENTS

| | | | |
|---|---|---|---|
| 3,314,858 | 4/1967 | Villadsen | 176/38 |
| 3,755,077 | 8/1973 | Agrainier et al. | 176/78 |
| 3,795,579 | 3/1974 | Chenal et al. | 176/78 |
| 3,892,625 | 7/1975 | Patterson | 176/61 |
| 4,111,747 | 9/1978 | Eck et al. | 176/78 |
| 4,166,003 | 8/1979 | Bhattacharyya et al. | 176/50 |

OTHER PUBLICATIONS

ANS Trans., vol. 27, 11/27-12/2/77, pp. 426-428, 432, 433.

Nuclear Sci. & Eng., vol. 63, 1957, pp. 336-341, Harms et al.

*Primary Examiner*—Harvey E. Behrend

*Attorney, Agent, or Firm*—James E. Denny; Richard G. Besha; Frank H. Jackson

[57] ABSTRACT

A target for a proton beam which is capable of generating neutrons for absorption in a breeding blanket includes a plurality of solid pins formed of a neutron emissive target material disposed parallel to the path of the beam and which are arranged axially in a plurality of layers so that pins in each layer are offset with respect to pins in all other layers, enough layers being used so that each proton in the beam will strike at least one pin with means being provided to cool the pins. For a 300 mA, 1 GeV beam (300 MW), stainless steel pins, 12 inches long and 0.23 inches in diameter are arranged in triangular array in six layers with one sixth of the pins in each layer, the number of pins being such that the entire cross sectional area of the beam is covered by the pins with minimum overlap of pins.

6 Claims, 4 Drawing Figures

TARGET ASSEMBLY

CONTRACTUAL ORIGIN OF THE INVENTION

The invention described herein was made in the course of, or under, a contract with the UNITED STATES DEPARTMENT OF ENERGY.

BACKGROUND OF THE INVENTION

This invention relates to a target assembly adapted for use with a particle accelerator to generate neutrons. In more detail, the invention relates to an accelerator-breeder plant consisting of a novel target assembly composed of a neutron emissive target material which target assembly is driven by a linear accelerator producing a high intensity beam of protons and drives a blanket containing fertile material.

An alternative to the production of fissile material in an enrichment plant or a fast breeder reactor is to employ an accelerator-breeder plant. In an accelerator breeder plant neutrons produced by directing a high power, high current proton beam into a suitable target material are absorbed in a suitable breeding blanket. No feasible design has yet been suggested for the target/-blanket portion thereof.

Target design involves a balance between (1) physics of neutron and heat production in the target, (2) thermal-hydraulics of heat removal from the target, (3) materials performance in the proton/neutron field of the target, (4) efficient transfer of neutrons from target to blanket, and (5) blanket design constraints on peak power density, radial and axial power distribution, and fissile production distribution. Power densities typical of solid, high mass number, targets are impossible to cool for beam powers of the order of 300 MW (1 GeV, 300 mA). Three options are open: (1) operate at a beam power much lower than 300 MW, (2) operate with a flowing molten target using the heat capacity of the target material to carry away the heat, or (3) devise a way to distribute the thermal power production in the target over a much greater distance in the axial (i.e. beam) direction so as to reduce the power density. Use of a reduced beam power implies an undesirable lower fissile production rate. Mechanical design problems for flowing molten targets at the 300 MW beam power level are formidable, and a practical design is probably infeasible. Further, the low height-to-diameter ratio of the neutron production volume in high mass number molten targets results in a significant fraction of the neutrons born in the target not reaching the radial blanket. Thus this invention relates to the third design option.

SUMMARY OF THE INVENTION

According to the present invention, a linear accelerator capable of producing a high power, high current proton beam and a state of the art breeding blanket are coupled by a target for the proton beam consisting of a plurality of solid pins formed of a neutron emissive target material disposed parallel to the path of the beam and arranged axially in a plurality of layers so that pins in each layer are offset with respect to pins in all other layers, enough layers being used so that each proton in the beam will strike at least one pin with means being provided to cool the pins. For a 300 mA, 1 GeV beam (300 MW), stainless steel pins, 12 inches long and 0.23 inches in diameter are arranged in triangular array in six layers with one sixth of the pins in each layer, the number of pins being such that the entire cross sectional area of the beam is covered by the pins with minimum overlap of pins.

DESCRIPTION OF THE PREFERRED EMBODIMENT

Figure 1:
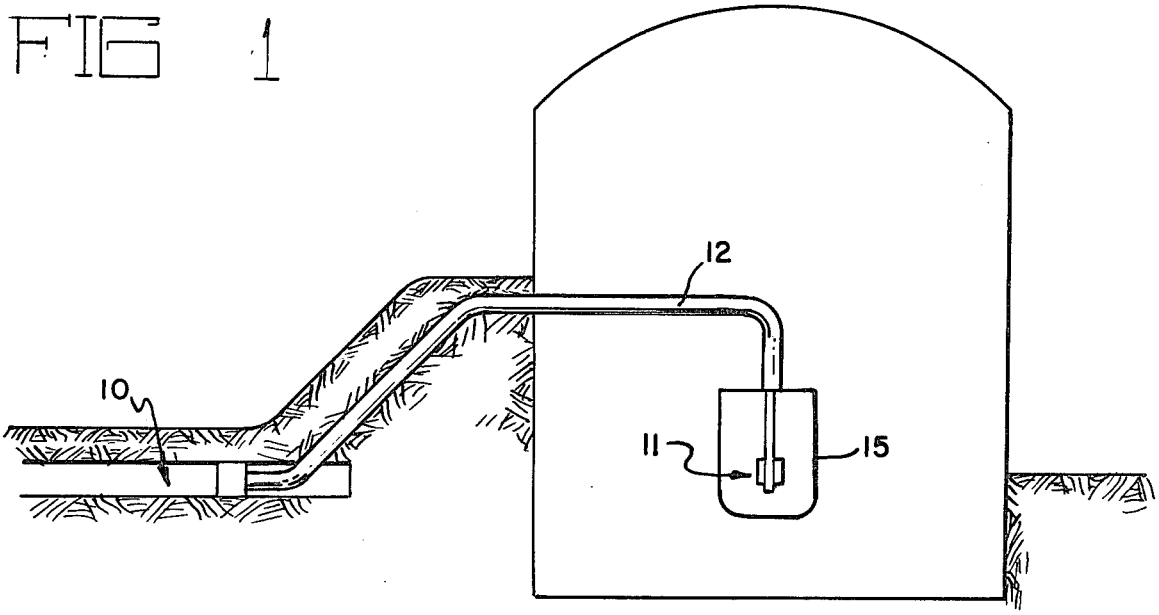
FIG. 1 is a diagrammatic representation of an accelerator-breeder plant.
Figure 2:
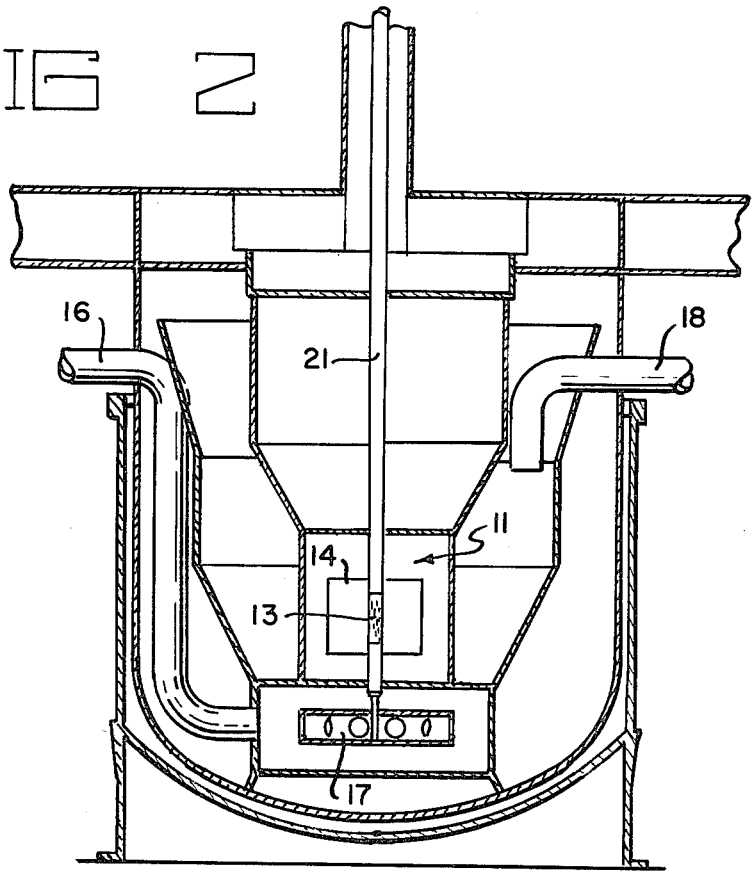
FIG. 2 is a diagrammatic vertical section of the breeder portion thereof.

Referring now to the drawing an accelerator breeder plant includes a linear accelerator 10—preferably disposed underground—which produces a high power, high current beam of protons which are conducted to target/blanket 11 through conduit 12. The linear accelerator produces, for example, a 30 mA, 1 GeV proton beam (300 MW). In target/blanket system 11 the proton beam impinges on a target assembly 13 containing neutron emissive target material and the neutrons generated are absorbed in a blanket 14 surrounding the target assembly. The blanket incorporates conventional LMFBR-type blanket subassemblies and accordingly need not be further described. Target/blanket system 11 is contained within vessel 15. Liquid sodium coolant is introduced into vessel 15 through line 16, flows from plenum 17 upwardly through blanket 14 and target assembly 13 and exits vessel 15 through line 18.

Figure 3:
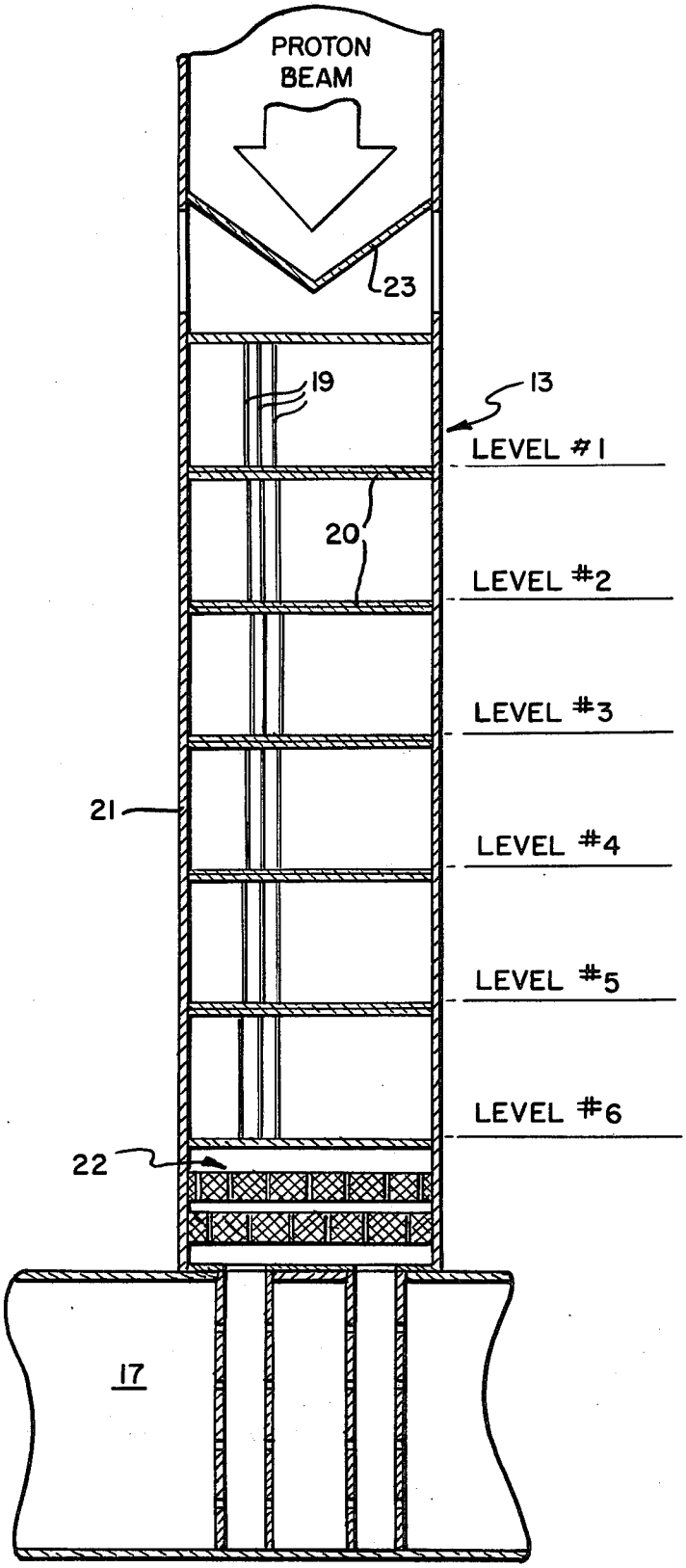
FIG. 3 is a vertical section of the target assembly thereof, showing for illustrative purposes several target pins of exaggerated size.

As shown in FIG. 3, target assembly 13 consists of a large number of thin elongated pins 19 supported by grid plates 20 within housing 21. Disposed immediately below target assembly 13 is a shield-blanket 22 and above is baffle 23 to deflect sodium coolant out of the beam path. Shield-blanket 22 finally stops the proton beam at the bottom end of the target and also reduces neutron leakage. Grid plates 20 have openings (not shown) therein to permit sodium coolant to flow therethrough.

Target pins 19 are disposed parallel to the path of the proton beam in a plurality of layers in which the pins in each layer are offset with respect to the pins in all other layers there being an equal number of pins in each layer. The pins are disposed so that the entire cross section of the beam is covered with minimum overlap of pins.

Figure 4:
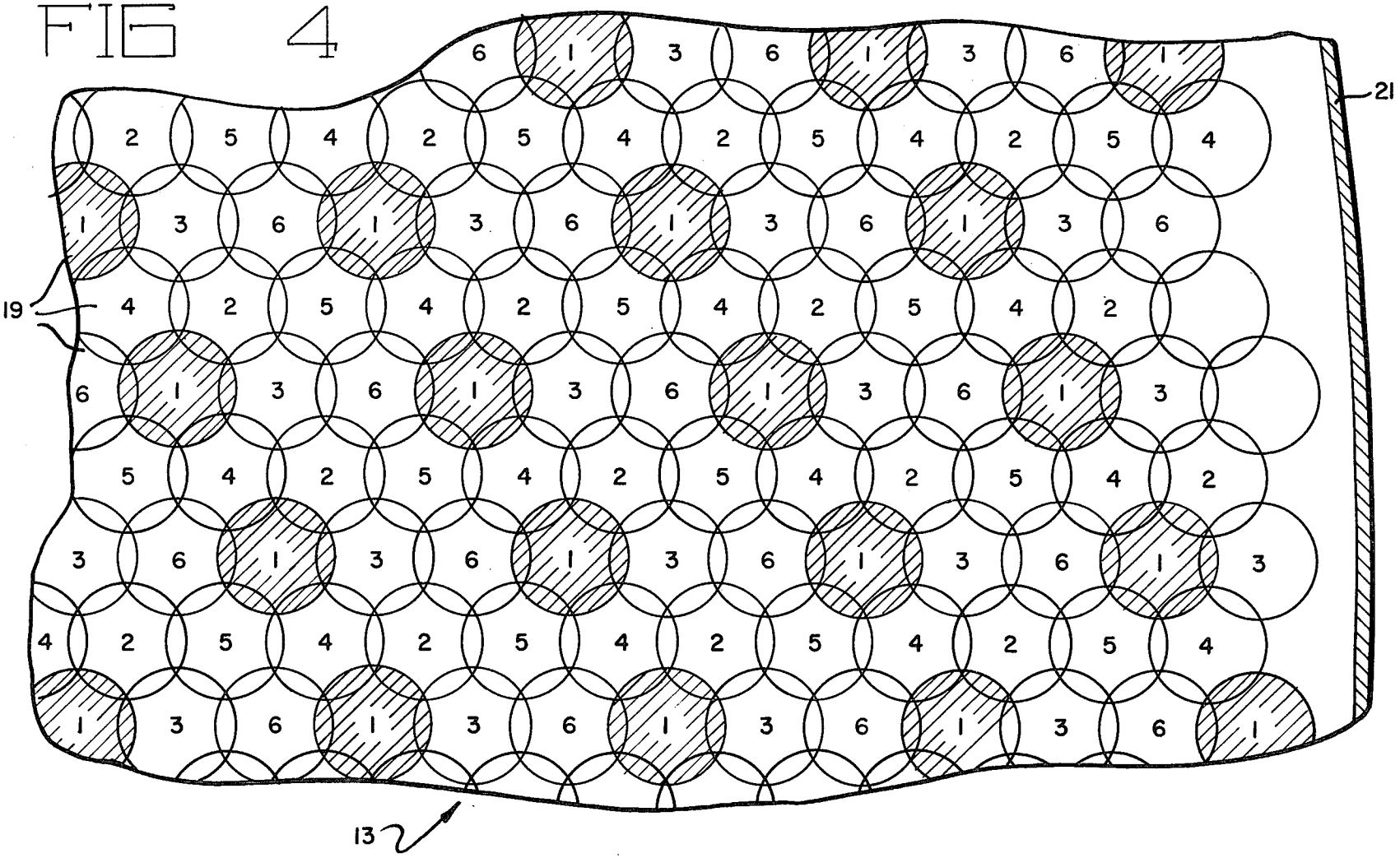
FIG. 4 is a diagram showing one possible layout of target pins.

According to the preferred embodiment of the invention, the target contains solid, type 316 stainless steel pins arranged in six layers with a sixth of the pins in each layer, one sixth of proton beam area being intercepted by the first layer, one sixth by the second layer, and so on. Stainless steel is selected because it appears it will have a reasonable lifetime under the conditions obtaining. For a 300 mA, 1 GeV (300 MW) proton beam the pins are 12 inches long and 0.23 inches in diameter. The diameter of the pins is such that the centerline temperature of the pins will be below melting temperature. The length of the pins is approximately one half the 1 GeV proton stopping distance in stainless steel whereby an incident proton will deposit most of its energy in the pin. Total diameter of the target is two feet. One possible arrangement of pins is shown in FIG. 4 wherein the number in the pin indicates the number of the layer in which it appears, the pins in the first layer being shaded for ease of understanding. It will be observed that the pins are circular in cross section. This is desirable because of economic considerations. Thus the pins must overlap to ensure that the entire cross sectional area of the proton beam is covered. As shown the pins in each layer are disposed at the corners of parallelograms, all pins taken together being disposed in triangular array since this is the simplest operable configuration. It will be appreciated that there may be nothing critical about this configuration and it may in fact develop on detailed analysis that a different arrangement may be possible.

I claim:

1. A target assembly capable of producing neutrons when bombarded with a high power, high current proton beam comprising a plurality of pins composed of a neutron emissive target material, the pins being disposed so that their axes parallel the beam path and being distributed axially in a plurality of layers containing an equal number of pins, the pins in each layer being offset from the pins in all other layers, the number and size of the pins being such that the entire cross sectional area of the proton beam is covered by the pins.

2. Target assembly according to claim 1 wherein the length of the pins is approximately one half the stopping distance for incident protons.

3. Target assembly according to claim 2 wherein the number of pins is such that overlap of pins is a minimum.

4. Target assembly according to claim 3 wherein the proton beam is a 300 mA, 1 GeV beam (300 MW) and the pins are stainless steel, 12 inches long, and 0.23 inches in diameter and the pins are distributed in six layers.

5. Target assembly according to claim 4 wherein the pins are arranged in triangular array.

6. In an accelerator breeder plant for producing fissile material comprising a linear accelerator capable of producing a high power, high current proton beam, a target assembly disposed in the path of the proton beam, a blanket for breeding fertile material surrounding said target assembly and means for cooling the blanket and target assembly, the improvement wherein said target assembly is constructed as defined in any of claims 1–5.

* * * * *